United States Patent [19]

Lautenschläger, Jr.

[11] 4,265,000

[45] May 5, 1981

[54] FURNITURE HINGE

[75] Inventor: Karl Lautenschläger, Jr., Reinheim, Fed. Rep. of Germany

[73] Assignee: Karl Lautenschlager KG, Mobelbeschlagfabrik, Reinheim, Fed. Rep. of Germany

[21] Appl. No.: 72,774

[22] Filed: Sep. 5, 1979

[30] Foreign Application Priority Data

Sep. 6, 1978 [DE] Fed. Rep. of Germany ..... 2838722

[51] Int. Cl.[3] ..... E05D 7/04

[52] U.S. Cl. ..... 16/129

[58] Field of Search ..... 16/129–134, 16/163, 164

[56] References Cited

U.S. PATENT DOCUMENTS

| | | | |
|---|---|---|---|
| 3,909,879 | 10/1975 | Grünert et al. | 16/131 |
| 4,176,422 | 12/1979 | Röck et al. | 16/130 |

FOREIGN PATENT DOCUMENTS

| | | | |
|---|---|---|---|
| 1459077 | 2/1969 | Fed. Rep. of Germany | 16/164 |
| 2356000 | 5/1975 | Fed. Rep. of Germany | 16/129 |
| 2548153 | 5/1977 | Fed. Rep. of Germany | 16/129 |
| 1782943 | 8/1978 | Fed. Rep. of Germany | 16/129 |

*Primary Examiner*—James Kee Chi

[57] ABSTRACT

Furniture hinge whose supporting-wall-related part adjustably held on a mounting plate fastened to the supporting wall of the piece of furniture is divided into an elongated body part and a head part which is adjustable relative to the body part at right angles to the hinge pivot axis and at right angles to the surface of the supporting wall and which bears the hinge linkage. The head part engages the body part with a dovetail-like guiding means, while a bore is provided in the plane of separation of the guiding means of the two parts, which bore lies half in the one and half in the other of the two parts. The one half of the bore in the head part is provided with a thread which is engaged by a threaded spindle situated in the bore, whose thread is interrupted by an annular groove which is engaged by a transverse projection extending from the other, otherwise smooth bore half in the body part. The threaded spindle protrudes at its bottom end from the bore towards the mounting plate and terminates in a retaining head of enlarged diameter which rests on the bottom of a longitudinal groove provided in the mounting plate and open towards the hinge linkage and having a narrowed mouth securing the holding head against lifting from the mounting plate.

5 Claims, 3 Drawing Figures

FURNITURE HINGE

BACKGROUND

This invention relates to a furniture hinge whose supporting-wall-related part adjustably held on a mounting plate fastened to the supporting wall of the furniture piece is divided into an elongated body part and a head part which bears the hinge linkage and is adjustable relative to the body part at right angles to the hinge pivot axis and at right angles to the surface of the supporting wall, the head part having a dovetail-like portion engaged in the body part, and in the plane of separation of these two parts a bore is provided half in the one and half in the other part, the one bore half being provided with a thread which is engaged by a threaded spindle lying in the bore whose thread is interrupted by a circumferential groove which is engaged by a transverse projection extending from the other, smooth half of the bore.

Such a division of the supporting-wall-related hinge part into a body part and a head part which is adjustable relative thereto by turning the threaded spindle in the described manner was developed (German Pat. No. 1,459,077) for hinges in which a relatively great adjustability is required for adaptation to different thickness of the supporting walls of furniture pieces such as cannot be achieved by the angular adjustment of the entire one-piece supporting-wall-related part relative to the mounting plate by means of the adjusting screw used in the conventional hinges.

THE INVENTION

The invention is addressed to the object of improving the known hinge, while retaining the advantageous great range of adjustment achieved by the division of the supporting-wall-related part, such that the installation and adjustment of the supporting-wall-related part on the mounting plate previously installed on the supporting wall will be accomplished still more simply and rapidly.

Setting out from a furniture hinge of the kind described above, this object is achieved in accordance with the invention by the fact that the threaded bore half is provided in the head part, and the smooth bore half containing the transverse projection is provided in the body part, and that the bottom end of the threaded spindle projects from the bore towards the mounting plate and terminates in a retaining head engaged in a T-slot provided in the mounting plate. In addition to the adjusting function, the threaded spindle thus also serves a mounting function for the supporting-wall-related part of the hinge, in that its retaining head is inserted into the T-slot in the mounting plate and is held in this T-slot. Since the threaded spindle, due to the transverse projection engaging its circumferential groove, is not displaceable relative to the body part of the supporting-wall-related part of the hinge, this body part is thus held by the retaining head of the threaded spindle in a given position with respect to the mounting plate, a longitudinal displacement parallel to the supporting wall being possible in the range provided by the length of the T-slot. Since the T-slot is open at its end facing the pivot axis of the hinge, the supporting-wall-related part of the hinge can be installed simply by inserting the retaining head into the T-slot. In other words, the installation of a door equipped with hinges in accordance with the invention on the supporting wall of a piece of furniture is especially simple.

If the hinge is so designed that the supporting-wall-related part thereof can be fixed at selected longitudinal positions on the mounting plate by means of the head of a threaded fastener passed through an elongated slot in the body part and screwed into a tap in the mounting plate, the design is advantageously immproved by providing the longitudinal slot adjacent the inside end of the body part and making this slot open at the inside end. The supporting-wall-related part can then, with the threaded fastener in place, be pushed onto the mounting plate, which represents a further simplification and expediting of the installation procedure.

The transverse projection provided in the smooth half of the bore can be in the form of a shallow raised segment integral with the wall of the bore half. However, more simple to mmanufacture is a design in which the projection provided in the smooth bore half and engaging the circumferential groove in the threaded spindle is formed by a portion of a pin inserted into a transverse bore in the body part and disposed at right angles to the axis of the bore and and tangential to the smooth bore half. The circumferential groove in the threaded spindle is in this case rounded to match the radius of the pin.

The invention will be further explained in the following description of an embodiment, in conjunction with the appended drawing, wherein.

Figure 1:
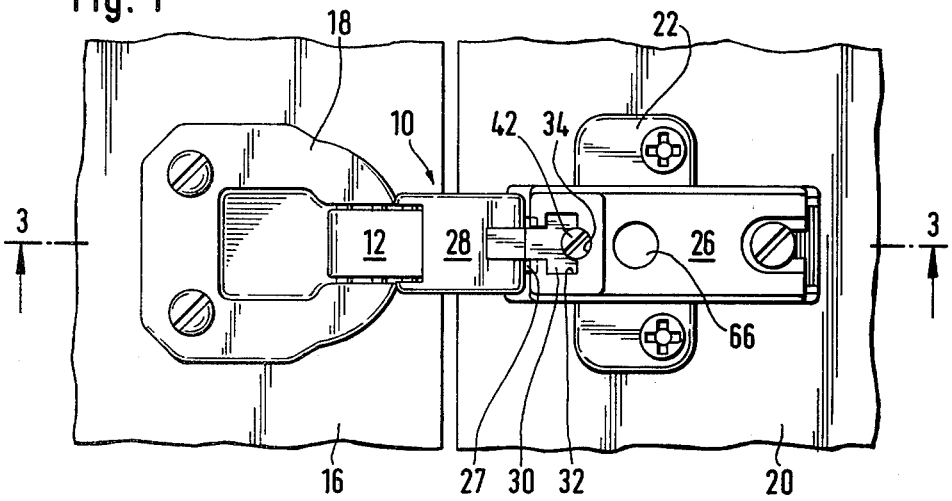
FIG. 1 is a top plan view of a hinge in accordance with the invention.

The hinge of the invention which is represented in the drawing and designated generally by the reference number 10 is composed of two parts coupled together by two links 12 and 14 in the manner of a quadruple articulation, namely the door-related part in the form of a cup 18 sunk in a mortise in the door 16, and the elongated, supporting-wall-related part 24 adjustably mounted on a mounting plate 22 fastened to the supporting wall 20 of the piece of furniture.

The supporting-wall-related part 24 is composed of an elongated rear body part 26 and a head part 28 on the door side thereof, which is guided in the main member and displaceable at right angles to the hinge pivot axis and at right angles to the surface of the supporting wall, the links 12 and 14 being articulated to the head part 28.

The means for the guidance of the head part 28 on or in the body part 26 is of such construction that a guiding projection 30 of T-shaped cross section projects from the side of the head part facing the body part and engages a complementary T-slot 32 in the body part. The guiding projection 30 therefore is engaged at its free end, which is of a T-shaped cross section, in the mating T-slot in the body part. It can be seen that, instead of the T-shaped configuration of the guiding head and of the slot, a dovetailed guiding means could be provided. To prevent the head part 28 of the hinge mounted on the supporting wall from being drawn unintentionally out of the body part when it is being adjusted, a projection 27 can be provided in the back of the head part facing the body part, with which there is associated an abutment 29 against which the projection 27 will strike before the head part can be separated from the body part, or before the engaged portions of the two parts becomes so short as to create a danger of breakage.

In the division between the guiding projection 30 and the back of the T-slot 32 there is provided a through bore 34, which therefore lies half in the guiding projection 30 and half in the main assembly 26. The bore half 36 on the head part is provided with screw threads 38, while the bore half 40 on the body part side has a smooth wall. The radius of the last-mentioned bore half 40 corresponds approximately to the outside diameter of the threads of a threaded spindle 42 inserted into bore 34 and engaging the threads 38, which has in its center a circumferential groove 44 in which it is turned down to its root diameter.

This circumferential groove 44 is engaged by the central section of a pin 48 driven into a transverse bore 46 in the body part 26 at right angles to the axis of the bore and tangentially to the smooth bore half 40; this pin can also be replaced by a transverse projection in the form of a shallow raised ring integral with the wall of bore half 40. In the illustrated case the annular groove in the threaded spindle 42 is rounded to match the radius of the pin 48.

The bottom end of the threaded spindle 42 projects from the bottom of bore 34 and is provided with a retaining head 50 of circular plan and of larger diameter than the shank of the spindle, which rests on the bottom of a T-slot 52 provided in the mounting plate 22 and having an open end facing the hinge linkage. The open mouth of the T-slot 52 is narrowed by lateral flanges 54 extending parallel to the supporting wall surface. Due to the T-shaped configuration of this slot, the head 50 of the threaded spindle cannot escape from it in the direction of the spindle axis; it can, however, be inserted without difficulty into the T-slot 52 through the open end thereof. The supporting-wall-related part 24 is affixed to the mounting plate 22 by means of a screw 56 threaded into a tap 58 provided in the mounting plate in the area of its interior end. The shank of the screw 56 passes through an open-ended longitudinal slot 60 in the interior end of the body part 26, so that therefore the supporting-wall-related part can be installed at this point, too, simply by sliding the open slotted end under the head of the loosened screw and tightening the latter.

Within the area allowed by the length of the longitudinal slot 60 and of the T-slot 52, the supporting-wall-related part 24 is displaceable longitudinally parallel to the surface of the supporting wall. By tightening the screw 56, the body part 26 is affixed to the mounting plate, the transverse grooving 62 and 64 in the superimposed surfaces of the main assembly and mounting plate providing an additional positive security against longitudinal displacement.

Figure 2:
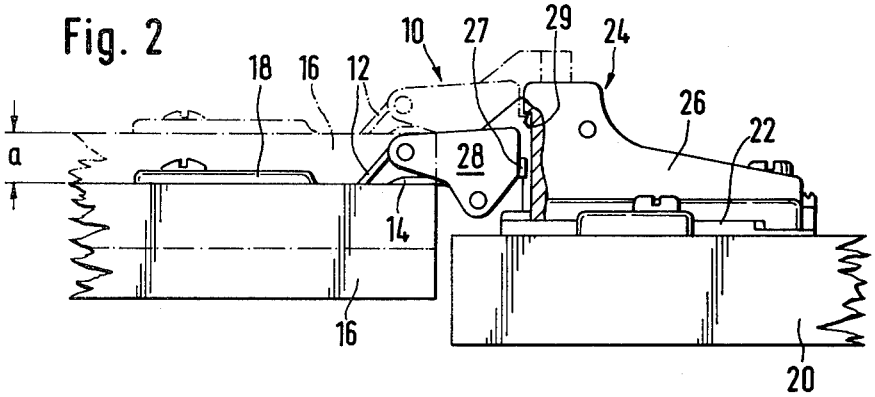
FIG. 2 is a side view of the hinge shown in FIG. 1.

It can be seen that, by turning the threaded spindle 42, the head part 28 can be shifted relative to the body part 26 and perpendicularly to the surface of the supporting wall 20. In FIG. 2, the possibility for the adjustment of the head part is indicated by the fact that, in addition to the head part position represented in solid lines, a second position of the head part is shown in dash-dotted lines, which position is offset by the amount a from the first position.

Figure 3:
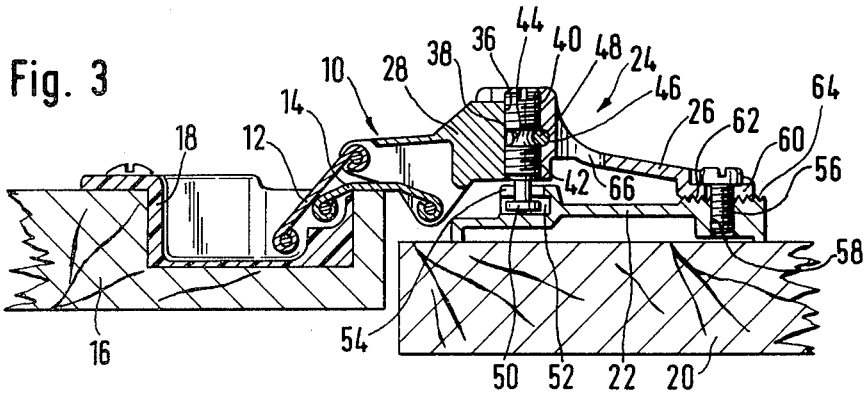
FIG. 3 is a cross-sectional side view through the hinge of the invention, as seen in the direction of the arrows 3—3 of FIG. 1.

It is to be noted that modifications and further developments of the hinge of the invention are possible within the scope of the invention. For example, it can be seen that sufficient room is provided in the head part for the installation of an over-center mechanism, so that the hinge can also be designed as an over-center hinge. In the hollow underside of the mounting plate, an additional mounting plate part can also be installed, which is fastened to the supporting wall 20, while the mounting plate part that is shown is made adjustable on this mounting plate part fastened to the supporting wall 20, parallel to the hinge pivot axis. In addition to the possibilities for adjustment lengthwise of the hinge and at right angles to the surface of the supporting wall, an adjustment parallel to the pivot axis of the hinge can also be achieved. The bore 66 shown in the main assembly 26 in FIGS. 1 and 3 permits in this case access to a fastening screw holding the two mounting plate parts together.

I claim:

1. In combination: a mounting plate to be fastened to the supporting wall of a piece of furniture, and a supporting-wall-related element of a furniture hinge, said element being held on said plate and having an elongated body part and a head part which is adjustable relative to the body part at right angles to the pivot axis of the hinge and at right angles to the surface of the supporting wall to which said part is to be connected, guiding means connecting said head and body parts, said guiding means comprising on one of said parts a guiding projection having a broadened free end engaging a complementary guiding slot with a narrowed mouth extending in the other part in the direction in which said parts are adjustable relative to each other, a bore being provided in a plane of separation of said guiding means, said bore being half in the one and half in the other of the two parts, the half of the bore provided in the head part having a thread, a threaded spindle situated in the bore and having a thread engaging said thread of said bore, said thread of said spindle being interrupted by an annular groove, a transverse projection extending from the other bore half in the body part and engaging said groove, said other bore half being smooth, said threaded spindle protruding from the bore towards the mounting plate and terminating in a retaining head of larger diameter than said spindle, said mounting plate having a longitudinal groove which has a bottom receiving said retaining head and which is open towards the hinge pivot axis, said longitudinal groove having a narrowed mouth securing the retaining head against being lifted from the mounting plate.

2. The combination according to claim 1, wherein said supporting-wall-related element has means for connecting the same clampingly at selected longitudinal positions on the mounting plate, said means including a head of a screw which is driven into a threaded bore in the mounting plate and passing through a longitudinal slot in said body part, said longitudinal slot being provided in the area of the end of the body part remote from the pivot axis and being open at its rearward end facing away from the said pivot axis.

3. The combination according to claim 1, wherein said transverse projection provided in the smooth bore half and engaging the annular groove in the threaded spindle is formed by a portion of a transverse pin which is inserted into a transverse bore in the body part which is at right angles to the central axis of the bore and tangential to the smooth bore half.

4. The combination according to claim 3, wherein said annular groove in the threaded spindle is rounded to match the radius of the transverse pin.

5. The combination according to any one of claims 1 to 4, comprising a projection on the surface of the head part facing the body part, and an abutment on the surface of the body part facing the projection, and which is engaged by the projection upon an adjustment of the head part relative to the body part in the direction away from the mounting plate, before the head part becomes separated form the body part.

* * * * *